United States Patent [19]

Hansel

[11] 4,059,135

[45] * Nov. 22, 1977

[54] INTERLOCK SYSTEM FOR A FUEL DISPENSING NOZZLE

[75] Inventor: William B. Hansel, Media, Pa.

[73] Assignee: Suntech, Inc., St. Davids, Pa.

[ * ] Notice: The portion of the term of this patent subsequent to Mar. 15, 1994, has been disclaimed.

[21] Appl. No.: 704,212

[22] Filed: July 12, 1976

Related U.S. Application Data

[63] Continuation-in-part of Ser. No. 635,189, Nov. 25, 1975, Pat. No. 4,011,897.

[51] Int. Cl.[2] ..... B65B 57/06

[52] U.S. Cl. ..... 141/207; 141/208

[58] Field of Search ..... 141/198–229, 141/1, 4, 5, 44, 52, 59, 93, 346, 347, 383–386; 220/85 UR, 85 US, 86 R

[56] References Cited

U.S. PATENT DOCUMENTS 3,911,973 10/1975 Casteline ..... 141/207

*Primary Examiner*—Houston S. Bell, Jr.

*Attorney, Agent, or Firm*—J. Edward Hess; Donald R. Johnson; Paul Lipsitz

[57] ABSTRACT

An interlock system for a fuel dispensing nozzle which prevents its operation until the nozzle is properly inserted into the fillpipe of a vehicle. The interlock system includes an actuation system which responds to the nozzle resting on the fillpipe opening at a predetermined point along the discharge spout of the nozzle and a valve located at the outlet of the vent tube from the automatic shut-off system. The interlock system is biased in such a manner that the valve remains closed at all times unless the nozzle is resting in the fillpipe in the proper manner. In this manner the valve causes the automatic shut-off system to disable the nozzle when it is not properly inserted in the fillpipe and permits the automatic shut-off system to act in its normal fashion when properly inserted, so that the nozzle is shut off when the liquid level in the fillpipe reaches the end of the discharge spout.

6 Claims, 5 Drawing Figures

INTERLOCK SYSTEM FOR A FUEL DISPENSING NOZZLE

CROSS REFERENCE TO RELATED APPLICATIONS

This application is a continuation-in-part of a copending application entitled "Interlock System For A Gasoline Dispensing Nozzle", Ser. No. 635,189, filed Nov. 25, 1975, now U.S. Pat. No. 4,011,897.

BACKGROUND OF THE INVENTION

This invention relates to nozzles for dispensing gasoline into vehicle fuel tanks and more specifically to an interlock system to prevent dispensing of gasoline until the discharge spout of a nozzle is inserted into the vehicle fuel pipe.

Current environmental regulations require in some areas that gasoline vapors displaced from a vehicle fuel tank while being filled are to be recovered in order to prevent their escape into the atmosphere. As part of these requirements, it is foreseeable that an interlock system may be required at some time in the future to prevent the dispensing of gasoline until the vapor receiving system is in contact with the vehicle fuel tank. Even if such a requirement never materializes, it is still desirable to have such an interlock system to encourage the filling station operator to have the vapor receiving system properly in place against the fillpipe before gasoline is dispensed.

The prior art has shown many designs for providing such an interlock system. One common method is to use a mechanical linkage between the face seal of the vapor receiving system and the automatic shut-off system within the nozzle housing itself. This type of a system tends to become overly complicated and significantly adds to the weight of the nozzle as well as to the cost of construction and maintenance.

Another design uses a valve located within the discharge spout and connected to the vent line which leads to the automatic shut-off system in the nozzle housing. This valve is then connected to the vapor receiving system in such a manner that it is closed when the vapor receiving system is not in contact with the vehicle fillpipe, thereby preventing the dispensing of gasoline. While this particular design is capable of working, it has at least one drawback in that the linkage mechanism between the valve and the vapor receiving system can greatly limit the flexibility of the vapor receiving system itself, thereby increasing the possibility of not obtaining a tight seal against the vehicle fillpipe.

Preferably, an interlock system should be designed in a way that does not interfere with the movement of the vapor receiving system so that a tight seal is formed reliably each time the nozzle is inserted into the fillpipe. Also, its design should be simple to permit ease of operation as well as to minimize manufacturing costs.

The actuation mechanism of the interlock system should be designed so that it operates automatically during normal use of the nozzle, but permits manual overriding of the system for filling tanks with unusual fillpipe designs. One system for accomplishing this result is shown in the above noted copending parent application, Ser. No. 635,189, now U.S. Pat. No. 4,011,847, which describes an actuation mechanism activated by the weight of the nozzle itself resting in the end of the fillpipe. It is therefore desirable to use such an actuation mechanism for an interlock system because it operates automatically and permits overriding.

It is therefore desirable to have an interlock system with an interlock and actuation mechanism which meet these considerations with minimal change to the conventional nozzle operation.

SUMMARY OF THE INVENTION

In accordance with a preferred embodiment, an interlock system is provided which maintains the dispensing nozzle in a disabled condition until the discharge spout is properly inserted within the fillpipe of the vehicle gasoline tank. The interlock system disclosed herein includes an interlock valve mounted at the end of the vent tube for the automatic shut-off system at the point where it terminates as an outlet at the end of the discharge spout. An interlock valve actuation system is provided on the discharge spout to sense the weight of the nozzle resting on the bottom of the fillpipe opening, which places the interlock valve in a closed position except when the presence of the nozzle resting in the fillpipe opening is sensed. The relationship between the interlock valve actuation system and the vapor receiving system can be designed so that by virtue of having the discharge spout fully inserted within the fillpipe, the vapor receiving system should, by its own design, be in contact with the outside edge of the fillpipe opening, thereby assuring a tight seal to prevent the escape of vapors.

This particular interlock system design provides several advantages. It is actuated solely by the weight of the nozzle resting on the fillpipe and requires no extraordinary assistance by the operator. In the case of its use on a nozzle having a vapor receiving system, no mechanical interface between the interlock system and the vapor receiving system is required, which can affect the ability of the vapor receiving system to make a tight seal against the fillpipe opening. Also, the interlock system design is a safety feature which acts to automatically shut the nozzle off almost before the end of the discharge spout leaves the fillpipe in the event that the nozzle should fall out of the fillpipe onto the ground.

A better understanding of the invention and its advantages can be seen in the following description of the figures and preferred embodiment.

DESCRIPTION OF THE FIGURES AND PREFERRED EMBODIMENT

The interlock system described herein can be used on most of the nozzles that are commercially available today and with many of the vapor receiving systems available. However, an ideal nozzle and vapor receiving system, which is lightweight and particularly adaptable to such an interlock system, is that disclosed in U.S. Pat. No. 3,734,339 issued to Young and that disclosed in a copending patent application entitled "Gasoline Dispensing Nozzle With Vapor Receiving System", by Hansel, filed Sept. 2, 1975, Ser. No. 609,760, respectively. Aspects of both are used herein for illustrative purposes.

Figure 1:
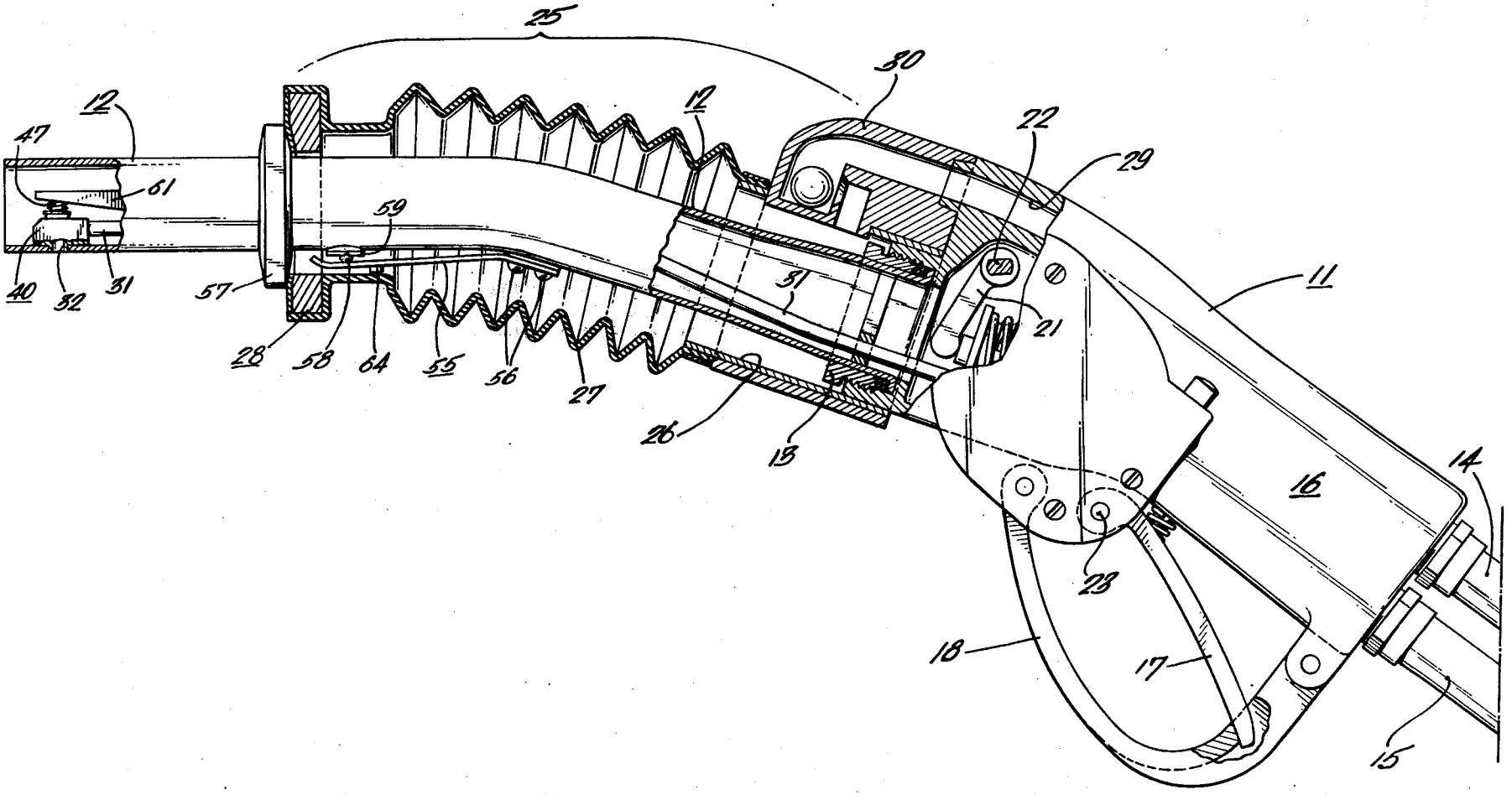
FIG. 1 illustrates a dispensing nozzle with a vapor receiving system and with the interlock system according to this invention.
Figure 2:
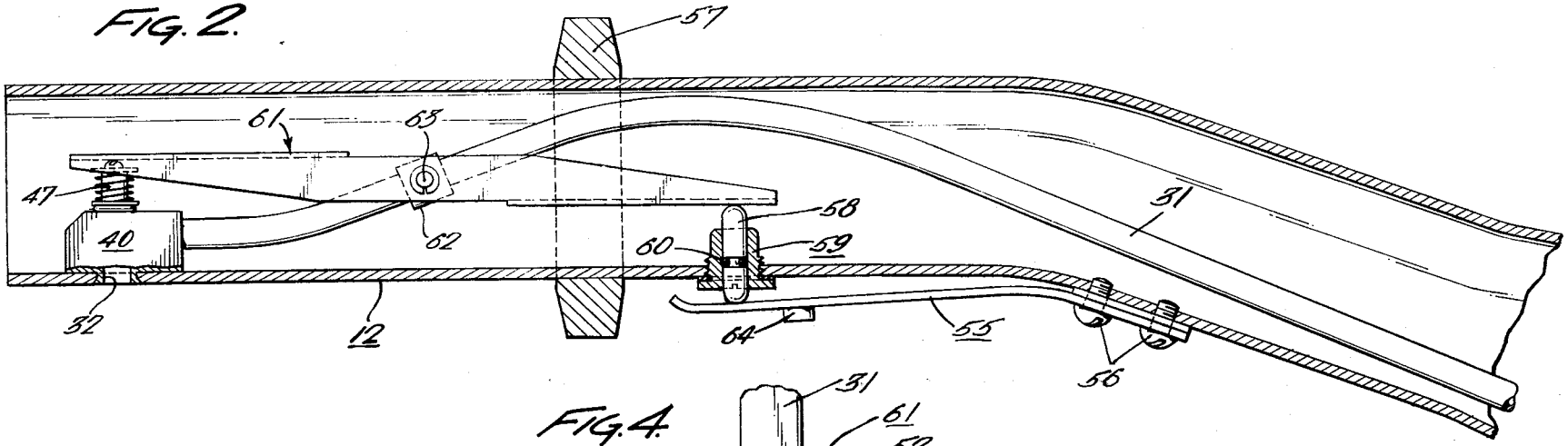
FIG. 2 illustrates the interlock system in FIG. 1 in an enlarged partial sectional view.

Referring to FIG. 1, the basic nozzle and vapor receiving components will be discussed first. The nozzle assembly has a housing 11 with a discharge spout 12 connected thereto by retaining nut 13. A vapor return hose 14 and a gasoline hose 15 connect to handle portion 16 of housing 11. Operation of the nozzle is accomplished by squeezing lever 17 against handle 16. Guard 18 acts to protect actuating lever 17 as well as to provide a support for holding the nozzle when it is inserted into the pump housing for storage when not in use.

The components inside the nozzle include a main poppet valve for controlling the flow of gasoline through the nozzle. Rotation of operating arm 21 on shaft 22 toward the main poppet valve causes it to open. Shaft 22 is connected to pivot shaft 23 of lever 27 through an automatic shut-off mechanism (not shown) which prevents gasoline from being dispensed when the liquid level in the container reaches the end of spout 12. The shut-off mechanism can be a pressure responsive diaphragm system, the principles of which are well known. A more detailed explanation of the operation of this system is contained in the patent issued to Young.

A possible design for a vapor receiving system which is used for illustrative purposes and which is similar to that shown in copending patent application entitled "Gasoline Dispensing Nozzle With Vapor Receiving System", Ser. No. 609,760, filed Sept. 2, 1975, will now be described. The vapor receiving system includes a vapor receiving chamber which is generally denoted by the number 25 and comprises three general sections, non-flexible housing 26, flexible bellows 27, and magnetic seal section 28. A vapor return passageway 29 extends from non-flexible housing 26, through nozzle housing 11 where it is connected to vapor return line 14.

On the top of housing 26 is an attitude valve, 30, which is in fluid communication with the top of the underground storage tanks (not shown) through vapor return hose 14, and vapor return passageway 29 in nozzle housing 11. Attitude valve 30 is used for preventing the vapors in the underground storage tanks from being displaced back into the atmosphere through vapor receiving chamber 25 when the nozzle is not in use and stored in an upright position on the pump. An attitude valve of similar design and operation is illustrated and discussed in more detail in copending patent application entitled "Attitude Valve For A Gasoline Dispensing Nozzle With A Vapor Receiving System", by Hansel, Ser. No. 609,761, filed Sept. 2, 1975.

Most conventional gasoline dispensing nozzles use a balanced diaphragm shut-off system which acts in response to a pressure differential produced when the fillpipe in the vehicle gasoline tank becomes filled with gasoline. Such a system is also included in the nozzle of the above mentioned Young patent. As illustrated in the drawings, vent tube 31 travels through discharge spout 12 from opening 32 to one of the pressure chambers on one side of the shut-off diaphragm (not shown). This side of the chamber is also connected to a venturi arrangement so that the flow of gasoline creates a vacuum on this side of the diaphragm which is relieved by having opening 32 in spout 12 open. However, when opening 32 is closed, such as by gasoline reaching the end of the spout, the vacuum from the venturi causes the shut-off diaphragm to disengage lever 17 so that gasoline can no longer be dispensed.

Interlock valve 40 is designed to be placed at the end of vent tube 31 at outlet 32. Included inside the valve body of valve 40 is a horizontal chamber 41 having an enlarged diameter section 42 for receiving the end of vent tube 31, and a vertical chamber 43 passing from the lower side of valve 40 through horizontal chamber 41 and through the upper side of the valve body. Vertical chamber 43 is designed to have a large diameter section at the lower end to form outlet 32 for vent line 31, a frusto-conical section 44 which acts to form a valve seat 45. A valve head 46 is disposed within section 44 so that movement of the valve head 46 upward against valve seat 45 causes the valve to obtain a closed position. The valve head 46 is connected to a valve stem 47 which extends through vertical chamber 43, above horizontal chamber 41 and upward above the top side of the valve body.

Figure 4:
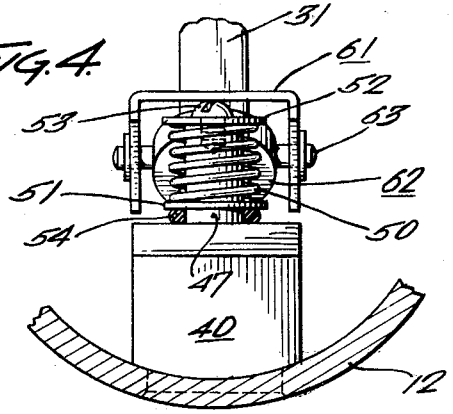
FIG. 4 is a partial section along the line 4—4 in FIG. 3.

Biasing means for valve 40 is provided by expansion spring 50 (see FIG. 4) which is mounted around valve stem 47 between disc 51, which is slidably mounted around valve stem 47, and a second disc 52 secured on the end of valve stem 47 by screw 53. In this fashion, the valve 40 is biased in a normally closed fashion. An "0" ring 54 is located between the upper surface of the body of valve 40 and disc 51. The pressure normally applied by biasing spring 50 on disc 51 serves to provide a tight seal for valve stem 47.

Many different ways for actuating the interlock valve can be designed. However, as discussed in the copending parent application for this application, it is desirable to have an actuation mechanism which acts in response to the weight of the nozzle resting on the fillpipe opening.

Accordingly, the actuation system includes an actuator arm 55 secured at one end to spout 12 by screws 56 and extends in the direction toward the discharge end of spout 12, terminating immediately before latching collar 57. The shape of arm 55 in relationship to the bend of the lower side of discharge spout 12 is such that arm 55 acts as a flat spring and remains biased at its free end away from the lower side of spout 12 a predetermined distance. A catch 64 is provided on arm 55 as a second latching point for deeper insertion of the spout into a vehicle fillpipe.

When the nozzle is inserted into the fillpipe with the discharge spout resting on the end of the fillpipe, arm 55 is displaced in an upward direction against spout 12. This linear displacement motion is used to operate valve 40 by transfer of this motion through a linking mechanism. A slidable pin 58 is mounted in pin housing 59, with "0" ring 60 acting as a seal. No biasing means is required for pin 58 since biasing means is provided by arm 55 and at interlock valve 40.

The motion transferred to pin 58 is transferred to interlock valve 40 through an actuating lever 61, which can be pivotally mounted to a collar 62 secured to vent tube 31, about trunnions 63. Lever 61 is designed to rest on top of valve stem 47 of interlock valve 40 at one end (see FIG. 4), and on top of pin 58 at the other end. As can now be appreciated, motion of arm 55 in an upward direction causes pin 58 to be moved upward against lever 61. Lever 61 is then rotated about trunnions 63 in a counterclockwise direction, causing valve stem 47 to be displaced in a downward direction, thereby moving valve head 46 away from valve seat 45 to open interlock valve 40.

Figure 5:
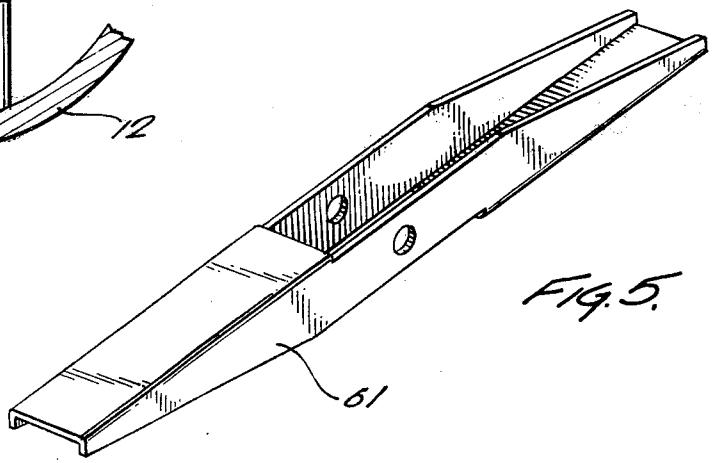
FIG. 5 is a pictorial view of the linking member 61.
Figure 3:
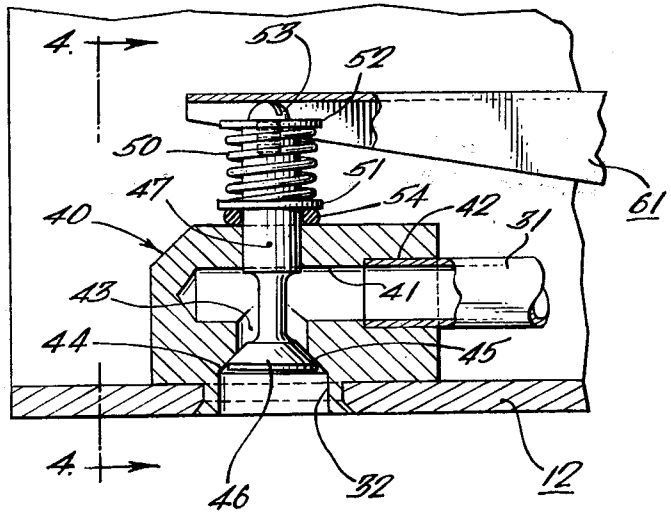
FIG. 3 is a sectional view of interlock valve 40.

One possible design for the actuating lever 61 is illustrated in FIG. 5, in which lever 61 is designed to have a "U" cross section throughout, with the exception of the center portion which pivots around trunnions 63, which has only two lateral sides. This configuration for lever 61 provides sufficient rigidity while permitting the use of light-weight material.

The interlock valve and its actuation mechanism are designed so the nozzle will not operate except when the nozzle is properly inserted in the fillpipe and released so that it will rest on the end of the fillpipe opening. This prerequisite for operation assures that the nozzle is fully inserted in the fillpipe and latched in place and that the vapor receiving system should be in position against the fillpipe opening, if the nozzle is equipped with such a system, before dispensing of gasoline is permitted.

If for some reason the nozzle is not properly inserted in the fillpipe, interlock valve 40 remains in its closed position. When dispensing of gasoline is attempted, a vacuum is experienced in vent tube 31 due to the venturi arrangement in the automatic shut-off system. Since valve 40 is still in the closed position, the vacuum created is not relieved and the automatic shut-off system disables the nozzle by disengaging lever 17.

Once the nozzle is properly inserted in the fillpipe, the weight of the nozzle causes arm 55 to rest against the bottom of the opening in the fillpipe and the spout 12 moves in a downward direction, causing pin 58 to move lever 61 in a counterclockwise direction with respect to its axis of rotation about trunnions 63. This motion cause interlock valve 40 to reach an open position since valve stem 47 is displaced in a downward direction, thereby providing an outlet for the vacuum developed in the venturi in the automatic shut-off system to be relieved to permit the normal dispensing of gasoline.

In the event that the nozzle should fall out of the fillpipe, interlock valve 40 will be immediately closed, thereby causing almost immediate shut-off of the nozzle by the automatic shut-off system. As a result, the possibility of the nozzle continuing operating while it has fallen on the ground has been effectively eliminated.

In the case of a car not having a conventional fillpipe design, the operator can still insert the discharge spout into the fillpipe and move the vapor receiving bellows back away from latching collar 57 and press arm 55 in an upward direction to cause the interlock valve 40 to reach an open position. While this permits the operator to avoid using the interlock system, it is sufficiently inconvenient to encourage the operator to fully insert the nozzle in the fillpipe in a proper manner.

While a particular embodiment of this invention has been shown and described, it is obvious that changes and modifications can be made without departing from the true spirit and scope of the invention. It is the intention of the appended claims to cover all such changes and modifications.

The invention claimed is:

1. A nozzle for dispensing fuel into a fillpipe of a motor vehicle fuel tank and comprising:

a. a discharge spout for insertion into a fillpipe of a motor vehicle fuel tank;

b. a shut-off valve for shutting off fuel being dispensed by the nozzle;

c. actuating means for closing said shut-off valve in response to fuel backed up into a fillpipe and including a vent line having an open end at the discharge end of the discharge spout, said vent line being supplied with a vacuum such that when gasoline covers the open end of the vent line, the pressure in the vent line drops and the pressure drop may be sensed to actuate said shut-off valve; and d. interlock means for preventing the dispensing of fuel through the nozzle until the discharge spout of the nozzle is properly inserted in a fillpipe and including a valve means located at the outlet of the vent line at the end of the discharge spout, said valve means having an open position wherein the vent line is open to the atmosphere and a closed position wherein the end of the vent line is sealed closed, and means, responsive to the nozzle being inserted in the fillpipe a predetermined distance and the lower side of the discharge spout being urged against the inside of a fillpipe inlet, for actuating the valve means so that the valve is placed into its open position, thereby permitting the dispensing of fuel.

2. The nozzle recited in claim 1, wherein the actuating means comprises means, mounted on the discharge spout, for sensing the weight of the nozzle resting on the fillpipe, with the mounting of the sensing means being selected to assure that the nozzle is inserted in the fillpipe a predetermined distance before the actuating means places the valve in its open position.

3. The nozzle recited in claim 2, wherein the sensing means produces a linear displacement having a predetermined length.

4. The nozzle recited in claim 3, wherein the valve means comprises:

a. a valve body having a first chamber, said chamber being connected to the outlet on the end of the discharge spout and having a valve seat within said chamber at said outlet;

b. a valve head disposed within the chamber so that when moved against the valve seat the valve obtains a closed position and the vent line is no longer open to the atmosphere through the outlet;

c. a valve stem connected to the valve head and extending out of the valve body;

d. means for linking the sensing means to the valve stem so that the linear displacement produced moves the valve stem; and e. means for biasing the interlock means so that the valve remains in a normally closed position.

5. The nozzle recited in claim 4, wherein the linking means comprises:

a. a pin, slidably mounted in the discharge spout so that it is moved in response to the sensing means; and b. lever means, pivoted inside the discharge spout, said means in contact with the pin on one end and the valve stem on the other end so that movement of the pin causes the valve stem to move.

6. The interlock system recited in claim 5, wherein the linking means further comprises pivoting means secured to a portion of the vent line in such a manner to provide pivot means for the lever means.

* * * * *